US007893343B2

(12) United States Patent
Kulkarni et al.

(10) Patent No.: US 7,893,343 B2
(45) Date of Patent: Feb. 22, 2011

(54) MUSICAL INSTRUMENT DIGITAL INTERFACE PARAMETER STORAGE

(75) Inventors: Prajakt Kulkarni, San Diego, CA (US); Nidish R. Kamath, Placentia, CA (US); Suresh Devalapalli, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 252 days.

(21) Appl. No.: 12/041,821

(22) Filed: Mar. 4, 2008

(65) Prior Publication Data

US 2008/0229915 A1 Sep. 25, 2008

Related U.S. Application Data

(60) Provisional application No. 60/896,404, filed on Mar. 22, 2007.

(51) Int. Cl.
*G10H 7/00* (2006.01)

(52) U.S. Cl. ..... 84/645; 84/601; 84/602; 84/604

(58) Field of Classification Search ..... None
See application file for complete search history.

(56) References Cited

U.S. PATENT DOCUMENTS 5,054,360 A 10/1991 Lisle et al.
5,200,564 A 4/1993 Usami et al.
6,058,066 A 5/2000 Norris et al.
6,301,603 B1 * 10/2001 Maher et al. ..... 718/105
7,504,576 B2 * 3/2009 Georges ..... 84/645
2002/0128737 A1 * 9/2002 Fay et al. ..... 700/94
2002/0170415 A1 * 11/2002 Hruska et al. ..... 84/609
2005/0283262 A1 * 12/2005 Puryear ..... 700/94
2006/0111088 A1 * 5/2006 O'Rourke ..... 455/414.1
2006/0287747 A1 * 12/2006 Fay et al. ..... 700/94
2008/0229911 A1 * 9/2008 Kamath et al. ..... 84/603

FOREIGN PATENT DOCUMENTS

EP 0743631 11/1996

OTHER PUBLICATIONS

International Search Report-PCT/US2008/057208, International Searching Authority-European Patent Office-Jul. 16, 2008.
Written Opinion-PCT/US2008/057208, International Searching Authority-European Patent Office-Jul. 16, 2008.

* cited by examiner

*Primary Examiner*—Marlon T Fletcher
(74) *Attorney, Agent, or Firm*—Espartaco Diaz Hidalgo

(57) ABSTRACT

This disclosure describes techniques for processing audio files that comply with the musical instrument digital interface (MIDI) format. In particular, this disclosure describes storage of MIDI parameters for efficient access by a processor and a hardware unit. The processor may be a digital signal processor (DSP) and the hardware unit may be specifically designed to process MIDI parameters. In one aspect, this disclosure provides an apparatus comprising a processor that converts a MIDI event into MIDI parameters, a hardware unit that uses MIDI parameters to generate audio samples, and a plurality of storage units that store MIDI parameters which are accessible by both the processor and the hardware unit.

52 Claims, 7 Drawing Sheets

MUSICAL INSTRUMENT DIGITAL INTERFACE PARAMETER STORAGE

RELATED APPLICATIONS

Claim of Priority Under 35 U.S.C. §119

The present application for patent claims priority to Provisional Application No. 60/896,404 entitled "MUSICAL INSTRUMENT DIGITAL INTERFACE PARAMETER STORAGE" filed Mar. 22, 2007, and assigned to the assignee hereof and hereby expressly incorporated by reference herein.

TECHNICAL FIELD

This disclosure relates to audio devices and, more particularly, to audio devices that generate audio output based on musical instrument digital interface (MIDI) files.

BACKGROUND

Musical Instrument Digital Interface (MIDI) is a format used in the creation, communication and/or playback of audio sounds, such as music, speech, tones, alerts, and the like. A device that supports playback of MIDI files may store sets of audio information that can be used to create various "voices." Each voice may correspond to one or more sounds, such as a musical note by a particular instrument. For example, a first voice may correspond to a middle C as played by a piano, a second voice may correspond to a middle C as played by a trombone, a third voice may correspond to a D# as played by a trombone, and so on. In order to replicate the musical note as played by a particular instrument, a MIDI compliant device may include a set of information for voices that specify various audio characteristics, such as the behavior of a low-frequency oscillator, effects such as vibrato, and a number of other audio characteristics that can affect the perception of sound. Almost any sound can be defined, conveyed in a MIDI file, and reproduced by a device that supports the MIDI format.

A device that supports the MIDI format may produce a musical note (or other sound) when an event occurs that indicates that the device should start producing the note. Similarly, the device stops producing the musical note when an event occurs that indicates that the device should stop producing the note. An entire musical composition may be encoded in accordance with the MIDI format by specifying events that indicate when certain voices should start and stop. In this way, the musical composition may be stored and transmitted in a compact file format according to the MIDI format.

MIDI is supported in a wide variety of devices. For example, wireless communication devices, such as radiotelephones, may support MIDI files for downloadable sounds such as ringtones or other audio output. Digital music players, such as the "iPod" devices sold by Apple Computer, Inc and the "Zune" devices sold by Microsoft Corporation may also support MIDI file formats. Other devices that support the MIDI format may include various music synthesizers, wireless mobile devices, direct two-way communication devices (sometimes called walkie-talkies), network telephones, personal computers, desktop and laptop computers, workstations, satellite radio devices, intercom devices, radio broadcasting devices, hand-held gaming devices, circuit boards installed in devices, information kiosks, video game consoles, various computerized toys for children, on-board computers used in automobiles, watercraft and aircraft, and a wide variety of other devices.

SUMMARY

This disclosure describes devices that store Musical Instrument Digital Interface (MIDI) parameters for efficient access in the processing of such parameters. As described herein, a storage unit within memory may be partitioned into three regions comprising locations that can store different types of MIDI parameters. The partitioning allows for efficient access by both a processor and a hardware unit.

The MIDI parameters may be generated from MIDI events of a MIDI file. In particular, MIDI events may be converted into MIDI parameters via a processor, such as a digital signal processor (DSP). The DSP may divide the MIDI parameters into different parameter sets to be stored in a storage unit within memory. Memory may comprise a plurality of storage units. Also, the DSP may schedule the processing of the MIDI parameters in a hardware unit.

The storage unit within memory may be partitioned into at least three regions. A first region is accessible by both the processor and the hardware unit. A second region is accessible by the processor and inaccessible by the hardware unit. A third region is accessible by the hardware unit and inaccessible by the processor after initialization.

The hardware unit may access the MIDI parameters used to update new voices. The hardware unit may access one of the first and third regions of a partitioned storage unit within memory. The hardware unit may process the MIDI parameters stored in one of the first and third regions of the one of the partitioned storage units within memory and output audio samples.

In one example, this disclosure provides an apparatus comprising a processor that converts a MIDI event into MIDI parameters, a hardware unit that uses the MIDI parameters to generate audio samples, and a plurality of storage units that store the MIDI parameters, wherein the storage units are partitioned into at least three regions, wherein a first region is accessible by both the processor and the hardware unit, a second region is accessible by the processor and inaccessible by the hardware unit, and a third region is accessible by the hardware unit and inaccessible by the processor after initialization.

In another example, this disclosure provides a method comprising generating MIDI parameters for a MIDI event via a processor, generating audio samples via a hardware unit that uses the MIDI parameters, storing MIDI parameters in a plurality of storage units, partitioning one of the storage units into at least three regions, accessing a first region of the MIDI parameters via both the hardware unit and the processor, accessing a second region of the MIDI parameters via the processor, and accessing a third region of the MIDI parameters via the hardware unit, and initialized by the processor.

In another example, this disclosure provides an apparatus comprising means for converting a MIDI event into MIDI parameters, means for generating audio samples based on the MIDI parameters, and means for storing the MIDI parameters, wherein the means for storing includes a plurality of storage units, wherein each of the storage units in the means for storing is partitioned into at least three regions, wherein a first region of each of the storage units is accessible by both the means for generating and the means for converting, a second region of each of the storage units is accessible by the means for converting and inaccessible by the means for generating, and a third region of each of the storage units is accessible by the means for generating and inaccessible by the means for converting after initialization.

In another example, this disclosure provides a computer-readable medium that stores MIDI parameters, the computer readable medium comprising a first region including first MIDI parameters accessible by a hardware unit and a processor, a second region including second MIDI parameters accessible by the processor, and a third region including third MIDI parameters accessible by the hardware unit and initialized by the processor.

In another example, this disclosure provides a computer-readable medium comprising instructions that upon execution generate MIDI parameters for a MIDI event via a processor, generate audio samples via a hardware unit that uses the MIDI parameters, store MIDI parameters in a plurality of storage units, partition one of the storage units into at least three regions, access a first region of the MIDI parameters via both the hardware unit and the processor, access a second region of the MIDI parameters via the processor, and access a third region of the MIDI parameters via the hardware unit, and initialized by the processor.

In another example, this disclosure provides a circuit adapted to generate MIDI parameters for a MIDI event via a processor, generate audio samples via a hardware unit that uses the MIDI parameters, store MIDI parameters in a plurality of storage units, partition one of the storage units into at least three regions, access a first region of the MIDI parameters via both the hardware unit and the processor, access a second region of the MIDI parameters via the processor, and access a third region of the MIDI parameters via the hardware unit, and initialized by the processor.

The details of one or more examples are set forth in the accompanying drawings and the description below. Other features, objects, and advantages will be apparent from the description and drawings, and from the claims.

DETAILED DESCRIPTION

This disclosure describes techniques for processing audio files that comply with a musical instrument digital interface (MIDI) format. As used herein, the term MIDI file refers to any audio data or file that contains at least one audio track that conforms to the MIDI format. Examples of various file formats that may include MIDI tracks include CMX, SMAF, XMF, SP-MIDI to name a few. CMX stands for Compact Media Extensions, developed by Qualcomm Inc. SMAF stands for the Synthetic Music Mobile Application Format, developed by Yamaha Corp. XMF stands for eXtensible Music Format, and SP-MIDI stands for Scalable Polyphony MIDI. As described in greater detail below, this disclosure provides techniques for storing, accessing, and processing various MIDI events of a MIDI file.

A general processor may execute software to parse MIDI files and schedule MIDI events associated with the MIDI files. The general processor dispatches the MIDI events to a second processor, which may be a digital signal processor (DSP), in a time-synchronized manner, and the DSP processes the MIDI events according to the time-synchronized schedule in order to generate MIDI parameters. The DSP then stores the MIDI parameters in memory. The memory comprises a plurality of storage units, which are accessible by the DSP and a hardware unit.

The DSP may separate and store the MIDI parameters needed by a hardware unit to generate audio samples, and may store such MIDI parameters in a distinct region within a storage unit. The DSP may store the remaining MIDI parameters in a different region within the storage unit. The hardware unit may use the MIDI parameters stored in the storage unit to generate audio samples. The DSP may schedule the processing of hardware unit to generate audio samples. The generated audio samples are converted into analog signals, which can be used to drive speakers and output audio sounds to a user. In this way, the MIDI parameters are separated and stored in distinct parts for more efficient access.

Figure 1:
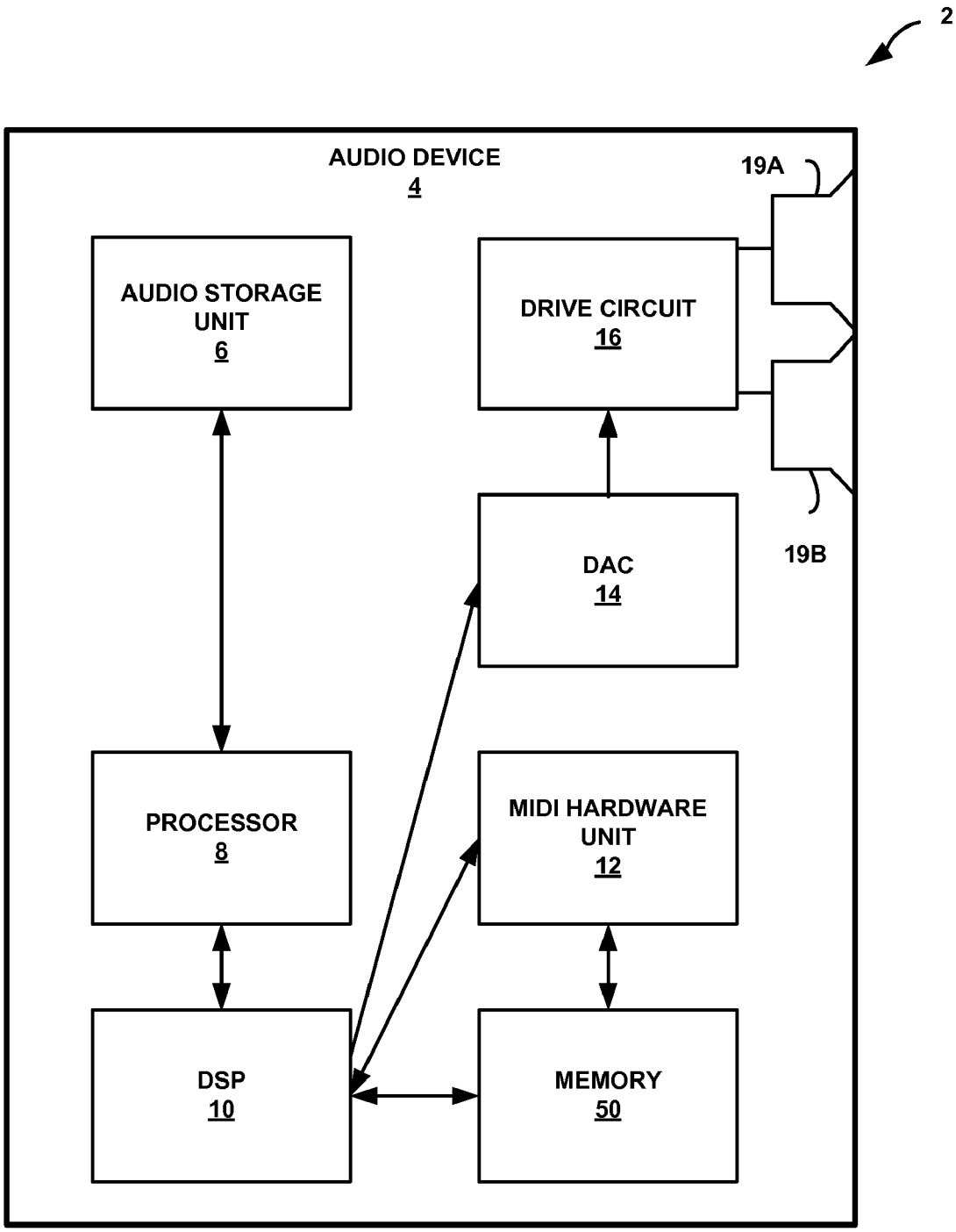
FIG. 1 is a block diagram illustrating an exemplary system that may implement the techniques of this disclosure.

FIG. 1 is a block diagram illustrating an exemplary system 2 that includes an audio device 4 to synthesize sound. Audio device 4 may comprise any device capable of processing MIDI files, e.g., files that include at least one MIDI track. Examples of audio device 4 include a wireless communication device such as a radiotelephone, a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, a circuit board installed in a device, a kiosk device, a video game console, various computerized toys for children, an on-board computer used in an automobile, watercraft or aircraft, or a wide variety of other devices.

The various components illustrated in FIG. 1 are provided to explain aspects of this disclosure. However, other components may exist and some of the illustrated components may not be included in some implementations. For example, if audio device 4 is a radiotelephone, then an antenna, transmitter, receiver and modem (modulator-demodulator) may be included to facilitate wireless communication of audio files.

As illustrated in the example of FIG. 1, audio device 4 includes an audio storage unit 6 to store MIDI files. Again, MIDI files generally refer to any audio file that includes at least one track coded in a MIDI format. Audio storage unit 6 may comprise any volatile or non-volatile memory or storage. For purposes of this disclosure, audio storage unit 6 can be viewed as an audio storage unit that forwards MIDI files to a general processor 8, or processor 8 retrieves MIDI files from audio storage unit 6, in order for the files to be processed. Of course, audio storage unit 6 could also be a storage unit associated with a digital music player or a temporary storage unit associated with information transfer from another device. Audio storage unit 6 may be a separate volatile memory chip or non-volatile storage device coupled to a general processor 8 via a data bus or other connection. A memory or storage device controller (not shown) may be included to facilitate the transfer of information from audio storage unit 6.

Device 4 may implement an architecture that separates MIDI processing tasks between software, hardware, and firmware. Processor 8 may comprise a general purpose processor that executes software to parse MIDI files and schedule MIDI events associated with the MIDI files. The scheduled events can be dispatched to a second general processor, which may be a digital signal processor (DSP) 10 in one example of device 4, in a time-synchronized manner and thereby serviced by DSP 10 in a synchronized manner, as specified by timing parameters in the MIDI files. DSP 10 processes the MIDI events according to the time-synchronized schedule created by processor 8 in order to generate MIDI parameters.

Device 4 may also implement an architecture in which the functionality ascribed to processor 8 and DSP 10 is combined into one processor, such as a multi-threaded DSP. In such an exemplary device, a first thread of the multi-threaded DSP may execute software to parse MIDI files and schedule MIDI events associated with the MIDI files. A second thread of the multi-threaded DSP may process the MIDI events according to the time-synchronized schedule created by the first thread of the multi-thread DSP. The first thread of the multi-threaded DSP may perform similarly to processor 8 as described herein. The second thread of the multi-threaded DSP may perform similarly to DSP 10 as described herein.

DSP 10 may also schedule subsequent processing of the MIDI synthesis parameters by MIDI hardware unit 12. MIDI hardware unit 12 generates audio samples based on the synthesis parameters. The second processor may be any type of processor capable of processing signals, and for illustration purposes, in one aspect of this disclosure, is DSP 10.

Processor 8 may comprise any of a wide variety of general purpose single- or multi-chip microprocessors. Processor 8 may implement a CISC (Complex instruction Set Computer) design or a RISC (Reduced Instruction Set Computer) design. Generally, processor 8 comprises a central processing unit (CPU) that executes software. Examples include 16-bit, 32-bit or 64-bit microprocessors from companies such as Intel Corporation, Apple Computer, Inc, Sun Microsystems Inc., Advanced Micro Devices (AMD) Inc., and the like. Other examples include Unix- or Linux-based microprocessors from companies such as International Business Machines (IBM) Corporation, RedHat Inc., and the like. The general purpose processor may comprise the ARM9, which is commercially available from ARM Inc., and the DSP may comprise the QDSP4 DSP developed by Qualcomm Inc.

After processor 8 reads a MIDI event, DSP 10 may convert the MIDI event to a set of MIDI parameters. Based on the MIDI event, processor 8 schedules MIDI events for processing by DSP 10, and dispatches the MIDI events to DSP 10 according to this scheduling. In particular, this scheduling by processor 8 may include synchronization of timing associated with MIDI events, which can be identified based on timing parameters specified in the MIDI files. MIDI instructions in the MIDI files may instruct a particular MIDI voice to start or stop. Other MIDI instructions may relate to aftertouch effects, breath control effects, program changes, pitch bend effects, control messages such as pan left of right, sustain pedal effects, main volume control, system messages such as timing parameters, MIDI control messages such as lighting effect cues, and/or other sound effects. After scheduling MIDI events, processor 8 may provide the scheduling to DSP 10 so that DSP 10 can process the events.

When DSP 10 receives scheduled MIDI events from processor 8, DSP 10 may process the MIDI events in order to generate MIDI parameters. The timing in which these MIDI events are serviced by DSP 10 is scheduled by processor 8, which creates efficiency by eliminating the need for DSP 10 to perform such scheduling tasks. Accordingly, DSP 10 can service the MIDI events for the first audio frame while processor 8 is scheduling MIDI events for the next audio frame. Audio frames may comprise blocks of time, e.g., 10 millisecond (ms) intervals, that may include several audio samples. The digital output, for example, may result in 480 samples per frame, which can be converted into an analog audio sample. Many events may correspond to one instance of time so that many notes or sounds can be included in one instance of time according to the MIDI format. Of course, the amount of time delegated to any audio frame, as well as the number of samples per frame may vary in different implementations.

After DSP 10 converts the MIDI event to a set of MIDI parameters, DSP 10 may transmit the parameters to memory 50 for data storing. Memory 50 may comprise multiple storage units within memory 50. Memory 50 may be any type of device capable of storing data. Memory 50 may also be any type of process for storing data, for example, using link lists or arrays to store data. For example, memory 50 may comprise storage units, which may be a registers, comprising memory locations configured to store a pointer pointing to each MIDI parameter value at a specific location.

Storage units within memory 50 may be partitioned into at least three regions. DSP 10 may divide the MIDI parameters into at least two sets and store each set into one of the three regions of storage units within memory 50. The storage units within memory 50 are described in detail below. Memory 50 may be integrated into one or more of the other devices in audio device 4, or may be a separate unit from MIDI hardware unit 12 and DSP 10.

DSP 10 may command MIDI hardware unit 12 to retrieve all the MIDI parameters stored in two of the regions of storage units within memory 50 for an individual MIDI frame in order to generate an audio sample. The data for one MIDI frame may be the MIDI parameters stored in every storage unit within memory 50. The audio samples may be a pulse-code modulation (PCM) signal. A PCM signal is a digital representation of an analog signal in which the analog signal is sampled at regular intervals. Each MIDI frame may correspond to approximately 10 milliseconds, or otherwise as specified in a header of the MIDI file. Upon receiving the MIDI parameters from the storage units within memory 50, DSP 10 may signal MIDI hardware unit 12 to process the parameters to generate the audio sample. MIDI hardware unit 12 may be any type of device capable of generating audio samples. MIDI hardware unit 12 may be integrated into one or more of the other devices in audio device 4, or may be a separate unit. Upon generating the audio samples, MIDI hardware unit 12 may output the audio samples to DSP 10 for any post processing.

The MIDI parameters stored in the storage units within memory 50 may be synthesis parameters and non-synthesis parameters. The synthesis parameters may be digital, and generally, the synthesis parameters define the wave shape of the analog audio sound. Synthesis parameters are all the necessary parameters to generate an audio sample. Some, but not all, synthesis parameters are modulation frequency, vibrato frequency, filter cut-off frequency, filter resonance, pitch envelope, and/or volume envelope. Table 1 is an exemplary list of synthesis parameters.

TABLE 1

| Synthesis Parameters in Memory |
|---|
| modulation Lfo frequency |
| Vibrato Lfo frequency |
| Filter Cut-off frequency |
| Filter resonance |
| waveform Base Pointer (waveloopLength, waveloopEnd) |
| Modulation LFO |
| Vibrato LFO |

TABLE 1-continued

| Synthesis Parameters in Memory |
|---|
| Pitch Envelope |
| Frequency Envelope |
| Volume Envelope |
| FilterMemory1 |
| FilterMemory2 |
| oscillator Phase |
| Modulation LFO Pitch Depth |
| Modulation LFO Volume Depth |
| Modulation LFO Frequency Depth |
| Vibrato LFO Pitch Depth |
| Pitch envelope ratio |
| Frequency Envelope Ratio |
| Volume Envelope ratio |
| phase Increment |
| digital Amplifier Gain Left |
| digital Amplifier Gain Right |

Non-synthesis parameters are those event parameters that are not used to generate an audio sample. In particular, non-synthesis parameters are parameters necessary for the general functionality of MIDI hardware unit 12, DSP 10, or memory 50, but do not define the wave shape. For example, non-synthesis parameters are usually the parameters that define the playing of the audio samples generated the MIDI hardware unit 12. Some, but not all, examples of non-synthesis parameters include voice number, voice time, voice program number, voice channel number, and/or voice key number. Non-synthesis parameters may be more than just parameters that define playing of audio samples. They may be any MIDI parameter necessary for the general functionality of the audio device 4. Table 2 is an exemplary list of non-synthesis parameters.

TABLE 2

| Non-synthesis parameters in Memory |
|---|
| Voice number |
| Voice time |
| Voice Sustain state |
| Voice Amplitude |
| Voice Exclusivity |
| Voice program number |
| Voice channel number |
| Voice key number |

Tables 1 and 2 are exemplary synthesis and non-synthesis parameters. In accordance with this disclosure, MIDI parameters are grouped and stored based on their need to be accessed by DSP 10 and hardware unit 12. Synthesis and non-synthesis parameters that need to be accessed by both DSP 10 and hardware unit 12 may be stored in the first region of storage units within memory 50. Synthesis and non-synthesis parameters that need to be accessed only by DSP 10 may be stored in the second region of storage units within memory 50. Synthesis and non-synthesis parameters that need to be accessed only by hardware unit 12 may be stored in the third region of storage units within memory 50. Thus, the regions of storage units within memory 50 may store both synthesis and non-synthesis parameters.

MIDI hardware unit 12 may use the synthesis parameters in generating audio samples. After generation of the audio sample, MIDI hardware unit 12 may output the audio sample in 10 millisecond frames when signaled by DSP 10. MIDI hardware unit 12 may process the parameters at 48 kilohertz, but the process rate may vary in different implementations. The process of generating the audio samples inside MIDI hardware unit 12 is well known in the art.

After generating the audio samples, MIDI hardware unit 12 may send an interrupt to DSP 10 signaling completion of generating audio samples. MIDI hardware unit 12 may then output the audio samples to DSP 10 for any post processing. After DSP 10 post processes the audio samples, DSP 10 may output this audio sample to a Digital-to-Analog converter (DAC) 14. DAC 14 converts the audio samples into an analog signal and outputs the analog signal to a driver circuit 16. Drive circuit 16 may amplify the signal to drive one or more speakers 19A and 19B to create audible sound.

Figure 2:
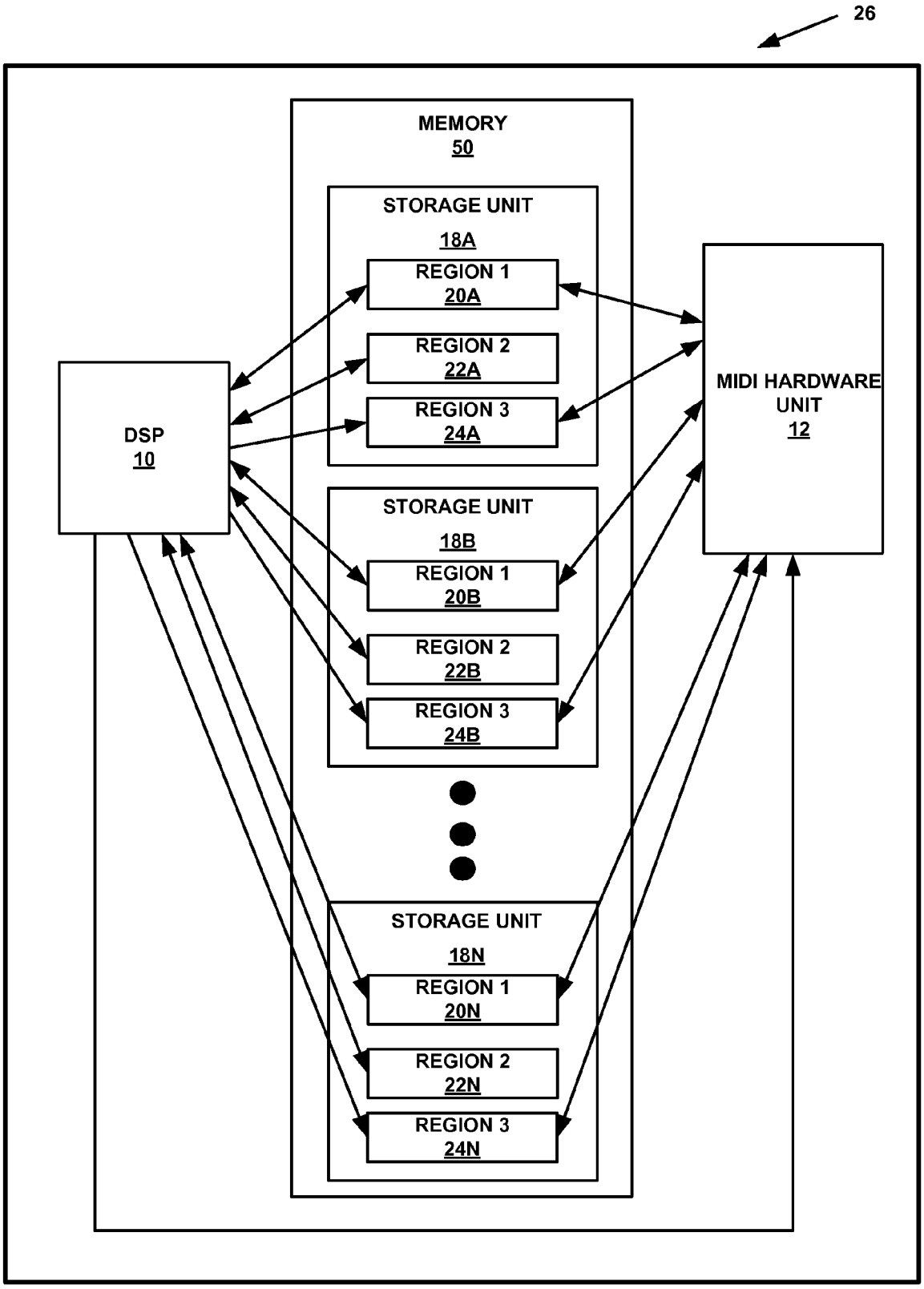
FIG. 2 is a block diagram illustrating an exemplary system for storing Musical Instrument Device Interface (MIDI) parameters.

FIG. 2 is a block diagram illustrating an exemplary system 26 that includes a general signal processor shown in exemplary system 26 as DSP 10, memory 50 to store MIDI parameters, and MIDI hardware unit 12. Memory 50 may include storage unit 18A through storage unit 18N. Storage unit 18A through storage unit 18N is collectively referred to as "storage units 18." Any number of storage units 18 may be used depending upon implementation.

Storage units 18 may be any type of device capable of storing data. For example, storage units 18 may be registers comprising memory locations configured to store a pointer pointing to each MIDI parameter value at a specific location. Each of storage units 18A-18N may be partitioned into at least three different regions, a first region 20A through first region 20N, a second region 22A through second region 22N, and third region 24A through 24N, respectively. Therefore, storage unit 18A comprises first region 20A, second region 22A, and third region 24A, and storage unit 18N comprises first region 20N, second region 22N, and third region 24N. First regions 20A-20N are collectively referred to as "first regions 20." Second regions 22A-22N are collectively referred to as "second regions 22." Third regions 24A-24N are collectively referred to as "third regions 24." Each region may be capable of storing both synthesis and non-synthesis parameters. Of course, there could be more than three regions within storage units 18 in a system.

In one example, first regions 20 of storage units 18 may be accessible by both DSP 10 and MIDI hardware unit 12. Second regions 22 of storage units 18 may be accessible by only DSP 10. Third regions 24 of storage units 18 may be accessible by MIDI hardware unit 12, and initialized by DSP 10. After initialization by DSP 10, third regions 24 may be inaccessible by DSP 10. That is, third regions 24 may be accessible by MIDI hardware unit 12 after third regions 24 are initialized by DSP 10, but is inaccessible to DSP 10 following initialization. "Accessible" is herein defined as being readable and writeable, while "initialize" is herein defined as to set the initial values by DSP 10. The initial values may be zero. Thus, first regions 20 may be readable and writeable by both DSP 10 and MIDI hardware unit 12. Second regions 22 may be readable and writeable by only DSP 10. And third regions 24 may be readable and writeable by MIDI hardware unit 12. DSP 10 can only write to third regions 24 when setting the initial value. After setting the initial value, DSP 10 cannot write to third regions 24, until a MIDI event specifies to initialize one of third regions 24. When the MIDI event specifies to initialize third regions 24, DSP 10 may only write the initial value to third regions 24. Between initializing MIDI events, DSP 10 may not write to third regions 24. DSP 10 may never read from third regions 24.

Storage units 18A-18N may be independent from each other. In that, one of storage units 18 may be initialized but not contain MIDI parameters, a second one of storage units 18 may already contain MIDI parameters, while a third one of storage units 18 may not be initialized. Therefore, first regions 20A-20N, second regions 22A-22N, and third regions 24A-24N may also be independent from each other.

Table 3 is an exemplary list of MIDI parameters that may be stored in first regions 20. The MIDI parameters in table 3 may be accessible by both DSP 10 and hardware unit 12. The list of MIDI parameters shown in Table 3 is merely exemplary.

TABLE 3

| MIDI parameters accessible by both the DSP and hardware unit |
|---|
| Modulation LFO |
| Vibrato LFO |
| Pitch Envelope |
| Frequency Envelope |
| Volume Envelope |
| Modulation LFO Pitch Depth |
| Modulation LFO Volume Depth |
| Modulation LFO Frequency Depth |
| Vibrato LFO Pitch Depth |
| Frequency Envelope Ratio |
| Volume Envelope ratio |
| phase Increment |
| Digital Amplifier Gain Right |
| Digital Amplifier Gain Left |

Table 4 is an exemplary list of MIDI parameters that may be stored in second regions 22. The MIDI parameters in table 4 may be accessible by only DSP 10. The list of MIDI parameters shown in Table 4 is merely exemplary.

TABLE 4

| MIDI parameters accessible only by the DSP |
|---|
| Voice number |
| Voice time |
| Voice Sustain state |
| Voice Amplitude |
| Voice Exclusivity |
| Voice program number |
| Voice channel number |
| Voice key number |

Table 5 is an exemplary list of MIDI parameters that may be stored in third regions 24. The MIDI parameters in table 5 may be accessible only by hardware unit 12 and initialized by DSP 10. The list of MIDI parameters shown in Table 5 is merely exemplary.

TABLE 5

| MIDI parameters accessible only by the hardware unit and initialized by the DSP |
|---|
| modulation Lfo frequency |
| Vibrato Lfo frequency |
| Filter Cut-off frequency |
| Filter resonance |
| waveform Base Pointer (waveloopLength, waveloopEnd) |
| FilterMemory1 |
| FilterMemory2 |
| oscillator Phase |
| Pitch envelope ratio |

DSP 10 may receive MIDI events and convert them into MIDI parameters. The MIDI parameters may be synthesis and non-synthesis parameters. DSP 10 may group the MIDI parameters into parameters accessible only by DSP 10, and parameters accessible by both DSP 10 and MIDI hardware unit 12. DSP 10 may output the MIDI parameters accessible by both DSP 10 and MIDI hardware unit 12 to one or more of first regions 20. DSP 10 may output the MIDI parameters accessible only by DSP 10 to one or more of second regions 22. In the event of a note-on or new voice, DSP 10 may initialize one or more of third regions 24. In the event of an existing voice, DSP 10 may not initialize one or more of third regions 24, and the MIDI parameters stored in one or more of third regions 24 may be updated by MIDI hardware unit 12. The phrase "Note-on" is used herein to refer to a MIDI event that is the first instance of a note when no other note is being processed in the frame. The term "New voice" is used herein to refer to a MIDI event that defines a first instance of a note when at least one other note is being processed in the frame. The term "Existing voice" is used herein to refer to a MIDI event where there is at least one note being processed throughout the entire frame, and no new note is processed in the frame. The term "note" may refer to any set of MIDI parameters requiring processing such as, but not limited to, a musical note.

In a further example, DSP 10 may signal MIDI hardware unit 12 to process the data to generate audio samples. MIDI hardware unit 12 may need to access the synthesis parameters of one or more first regions 20 and third regions 24. After generating audio samples, MIDI hardware unit 12 may need to store some MIDI parameters for the next frame. These MIDI parameters may be stored in one or more of third regions 24. The functionality of MIDI hardware unit 12 is described in detail below.

Figure 3:
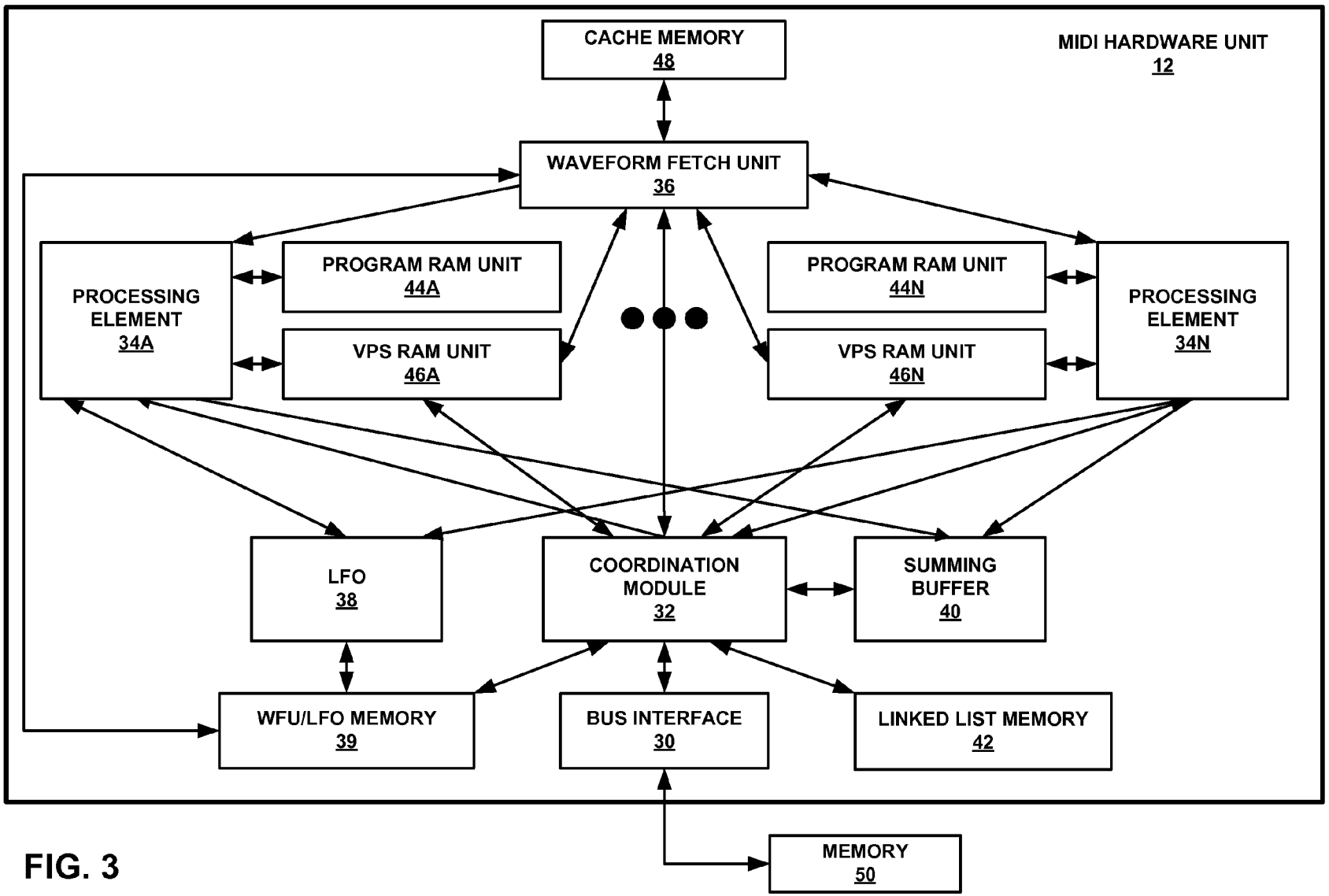
FIG. 3 is a block diagram illustrating an exemplary MIDI hardware unit of the audio device.

FIG. 3 is a block diagram illustrating an exemplary MIDI hardware unit 12, which may correspond to MIDI hardware unit 12 of audio device 4. The implementation shown in FIG. 3 is merely exemplary as other hardware implementations could also be defined consistent with the teaching of this disclosure. As illustrated in the example of FIG. 3, MIDI hardware unit 12 includes a bus interface 30 to send and receive data. For example, bus interface 30 may include an AMBA High-performance Bus (AHB) master interface, an AHB slave interface, and a memory bus interface. AMBA stands for advanced microprocessor bus architecture.

In addition, MIDI hardware unit 12 may include a coordination module 32. Coordination module 32 coordinates data flows within MIDI hardware unit 12. When MIDI hardware unit 12 receives an instruction from DSP 10 (FIG. 1) to begin synthesizing an audio sample, coordination module 32 reads the synthesis parameters for the audio frame from memory 50, which were generated by DSP 10 (FIG. 1). These synthesis parameters can be used to reconstruct the audio frame. For the MIDI format, synthesis parameters describe various sonic characteristics of one or more MIDI voices within a given frame. For example, a set of MIDI synthesis parameters may specify a level of resonance, reverberation, volume, and/or other characteristics that can affect one or more voices.

At the direction of coordination module 32, synthesis parameters may be loaded from memory 50 (FIG. 1) into voice parameter set (VPS) RAM 46A or 46N associated with a respective processing element 34A or 34N. At the direction of DSP 10 (FIG. 1), program instructions are loaded from memory 50 into program RAM units 44A or 44N associated with a respective processing element 34A or 34N.

The instructions loaded into program RAM unit 44A or 44N instruct the associated processing element 34A or 34N to synthesize one of the voices indicated in the list of synthesis parameters in VPS RAM unit 46A or 46N. There may be any number of processing elements 34A-34N (collectively "processing elements 34"), and each may comprise one or more ALUs that are capable of performing mathematical operations, as well as one or more units for reading and writing data. Only two processing elements 34A and 34N are illustrated for simplicity, but many more may be included in hardware unit 20. Processing elements 34 may synthesize voices in parallel with one another. In particular, the plurality of different processing elements 34 work in parallel to process different synthesis parameters. In this manner, a plurality of processing elements 34 within MIDI hardware unit 12 can accelerate and possibly improve the generation of audio samples.

When coordination module 32 instructs one of processing elements 34 to synthesize a voice, the respective processing element may execute one or more instructions associated with the synthesis parameters. Again, these instructions may be loaded into program RAM unit 44A or 44N. The instructions loaded into program RAM unit 44A or 44N cause the respective one of processing elements 34 to perform voice synthesis. For example, processing elements 34 may send requests to a waveform fetch unit (WFU) 36 for a waveform specified in the synthesis parameters. Each of processing elements 34 may use WFU 36. An arbitration scheme may be used to resolve any conflicts if two or more processing elements 34 request use of WFU 36 at the same time.

In response to a request from one of processing elements 34, WFU 36 returns one or more waveform samples to the requesting processing element. However, because a wave can be phase shifted within a sample, e.g., by up to one cycle of the wave, WFU 36 may return two samples in order to compensate for the phase shifting using interpolation. Furthermore, because a stereo signal may include two separate waves for the two stereophonic channels, WFU 36 may return separate samples for different channels, e.g., resulting in up to four separate samples for stereo output.

After WFU 36 returns audio samples to one of processing elements 34, the respective processing element may execute additional program instructions based on the synthesis parameters. In particular, instructions cause one of processing elements 34 to request an asymmetric triangular wave from a low frequency oscillator (LFO) 38 in MIDI hardware unit 12. By multiplying a waveform returned by WFU 36 with a triangular wave returned by LFO 38, the respective processing element may manipulate various sonic characteristics of the waveform to achieve a desired audio affect. For example, multiplying a waveform by a triangular wave may result in a waveform that sounds more like a desired musical instrument.

Other instructions executed based on the synthesis parameters may cause a respective one of processing elements 34 to loop the waveform a specific number of times, adjust the amplitude of the waveform, add reverberation, add a vibrato effect, or cause other effects. In this way, processing elements 34 can calculate a waveform for a voice that lasts one MIDI frame. Eventually, a respective processing element may encounter an exit instruction. When one of processing elements 34 encounters an exit instruction, that processing element signals the end of voice synthesis to coordination module 32. The calculated voice waveform can be provided to summing buffer 40 at the direction of another store instruction during the execution of the program instructions. This causes summing buffer 40 to store that calculated voice waveform.

When summing buffer 40 receives a calculated waveform from one of processing elements 34, summing buffer 40 adds the calculated waveform to the proper instance of time associated with an overall waveform for a MIDI frame. Thus, summing buffer 40 combines output of the plurality of processing elements 34. For example, summing buffer 40 may initially store a flat wave (i.e., a wave where all digital samples are zero.) When summing buffer 40 receives audio information such as a calculated waveform from one of processing elements 34, summing buffer 40 can add each digital sample of the calculated waveform to respective samples of the waveform stored in summing buffer 40. In this way, summing buffer 40 accumulates and stores an overall digital representation of a waveform for a full audio frame.

Summing buffer 40 essentially sums different audio information from different ones of processing elements 34. The different audio information is indicative of different instances of time associated with different generated voices. In this manner, summing buffer 40 creates audio samples representative of an overall audio compilation within a given audio frame.

Processing elements 34 may operate in parallel with one another, yet independently. That is to say, each of processing elements 34 may process a synthesis parameter, and then move on to the next synthesis parameter once the audio information generated for the first synthesis parameter is added to summing buffer 40. Thus, each of processing elements 34 performs its processing tasks for one synthesis parameter independently of the other processing elements 34, and when the processing for synthesis parameter is complete that respective processing element becomes immediately available for subsequent processing of another synthesis parameter.

Eventually, coordination module 32 may determine that processing elements 34 have completed synthesizing all of the voices required for the current audio frame and have provided those voices to summing buffer 40. At this point, summing buffer 40 contains digital samples indicative of a completed waveform for the current audio frame. When coordination module 32 makes this determination, coordination module 32 sends an interrupt to DSP 10 (FIG. 1). In response to the interrupt, DSP 10 may send a request to a control unit in summing buffer 40 (not shown) via direct memory exchange (DME) to receive the content of summing buffer 40. Alternatively, DSP 10 may also be pre-programmed to perform the DME. DSP 10 may then perform any post processing on the digital audio samples, before providing the digital audio samples to DAC 16 for conversion into the analog domain. In some cases, the processing performed by MIDI hardware unit 12 with respect to a frame N+2 occurs simultaneously with synthesis parameter generation by DSP 10 (FIG. 1) respect to a frame N+1, and scheduling operations by processor 8 (FIG. 1) respect to a frame N.

Cache memory 48, WFU/LFO memory 39 and linked list memory 42 are also shown in FIG. 3. Cache memory 48 may be used by WFU 36 to fetch base waveforms in a quick and efficient manner. WFU/LFO memory 39 may be used by coordination module 32 to store voice parameters of the voice parameter set. In this way, WFU/LFO memory 39 can be viewed as memories dedicated to the operation of waveform fetch unit 36 and LFO 38. Linked list memory 42 may comprise a memory used to store a list of voice indicators generated by DSP 10. The voice indicators may comprise pointers to one or more synthesis parameters stored in memory 50. Each voice indicator in the list may specify the memory location that stores a voice parameter set for a respective MIDI voice. The various memories and arrangements of memories shown in FIG. 3 are purely exemplary. The techniques described herein could be implemented with a variety of other memory arrangements.

In accordance with this disclosure, any number of processing elements 34 may be included in MIDI hardware unit 12 provided that a plurality of processing elements 34 operate simultaneously with respect to different synthesis parameters stored in memory 50 (FIG. 1) or memory 46 (FIG. 3). A first audio processing element 34A, for example, processes a first audio synthesis parameter to generate first audio information while another audio processing element 34N processes a second audio synthesis parameter to generate second audio information. Summing buffer 40 can then combine the first and second audio information in the creation of one or more audio samples. Similarly, a third audio processing element (not shown) and a fourth processing element (not shown) may process third and fourth synthesis parameters to generate third and fourth audio information, which can also be accumulated in summing buffer 40 in the creation of the audio samples.

Processing elements 34 may process all of the synthesis parameters for an audio frame. After processing each respective synthesis parameter, the respective one of processing elements 34 adds its processed audio information in to the accumulation in summing buffer 40, and then moves on to the next synthesis parameter. In this way, processing elements 34 work collectively to process all of the synthesis parameters generated for one or more audio files of an audio frame. Then, after the audio frame is processed and the samples in summing buffer are sent to DSP 10 for post processing, processing elements 34 can begin processing the synthesis parameters for the audio files of the next audio frame.

Again, first audio processing element 34A processes a first audio synthesis parameter to generate first audio information while a second audio processing element 34N processes a second audio synthesis parameter to generate second audio information. At this point, first processing element 34A may process a third audio synthesis parameter to generate third audio information while a second audio processing element 34N processes a fourth audio synthesis parameter to generate fourth audio information. Summing buffer 40 can combine the first, second, third and fourth audio information in the creation of one or more audio samples.

Figure 4:
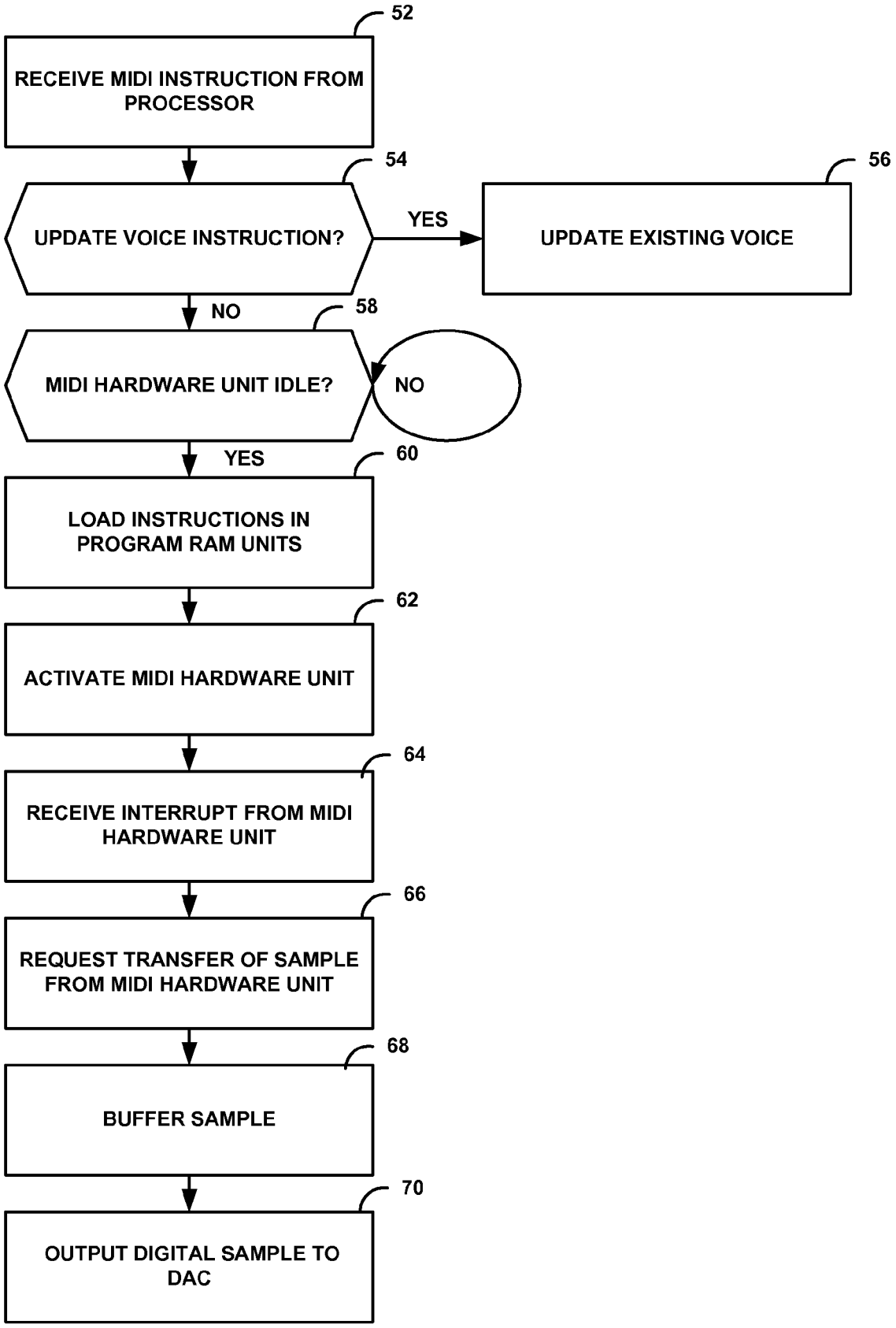
FIG. 4 is a flowchart illustrating an example operation of a Digital Signal Processor (DSP) in the audio device.

FIG. 4 is a flowchart illustrating an example operation of DSP 10 in audio device 4. Initially, DSP 10 receives a MIDI event from processor 8 (52). After receiving the MIDI event, DSP 10 determines whether the MIDI event is an instruction to update a parameter of a MIDI voice (54). For example, DSP 10 may receive a MIDI event to increase a gain for a left channel parameter in a set of voice parameters for a middle C voice for a piano. In this way, the middle C voice for a piano may sound like the note is coming from the left. If DSP 10 determines that the MIDI event is an instruction to update a parameter of a MIDI voice ("YES" of 54), DSP 10 may update the parameter in storage unit 18 (56).

On the other hand, if DSP 10 determines that the MIDI event is not an instruction to update a parameter of a MIDI voice ("NO" of 54), DSP 10 may determine whether MIDI hardware unit 12 is idle (58). MIDI hardware unit 12 may be idle before generating a digital waveform for a first MIDI frame of a MIDI file or after completing the generation of a digital waveform for a MIDI frame. If MIDI hardware unit 12 is not idle ("NO" of 58), DSP 10 may wait one or more clock cycles and then again determine whether MIDI hardware unit 12 is idle (58).

If MIDI hardware unit 12 is idle ("YES" of 58), DSP 10 may load a set of instructions into program RAM units 44 in MIDI hardware unit 12 (60). The instructions may be loaded from one of storage units 18 within memory 50. For example, DSP 10 may determine whether instructions have already been loaded into program RAM units 44. If instructions have not already been loaded into program RAM units 44, DSP 10 may transfer such instructions into program RAM units 44 using direct memory exchange. Alternatively, if instructions have already been loaded into program RAM units 44, DSP 10 may skip this step.

After DSP 10 has loaded the program instructions into program RAM units 44, DSP 10 may activate MIDI hardware unit 12 (62). For example, DSP 10 may activate MIDI hardware unit 12 by updating a register in MIDI hardware unit 12 or by sending a control signal to MIDI hardware unit 12. After activating MIDI hardware unit 12, DSP 10 may wait until DSP 10 receives an interrupt from MIDI hardware unit 12 (64). While waiting for the interrupt, DSP 10 may process and output a digital waveform for a previous MIDI frame to DAC 14. Upon receiving the interrupt, an interrupt service register in DSP 10 may set up a direct memory exchange request to transfer the digital waveform for a MIDI frame from summing buffer 40 in MIDI hardware unit 12 (66). In order to avoid long periods of hardware idling when the digital waveform in summing buffer 40 is being transferred, the direct memory exchange request may transfer the digital waveform from summing buffer 40 in thirty-two 32-bit word blocks. The data integrity of the digital waveform may be maintained by a locking mechanism in summing buffer 40 that prevents processing elements 34 from over-writing data in summing buffer 40. Because this locking mechanism may be released block-by-block, the direct memory exchange transfer may proceed in parallel to hardware execution. DSP 10 may perform any necessary post processing and output the data to DAC 14 (70).

Figure 5:
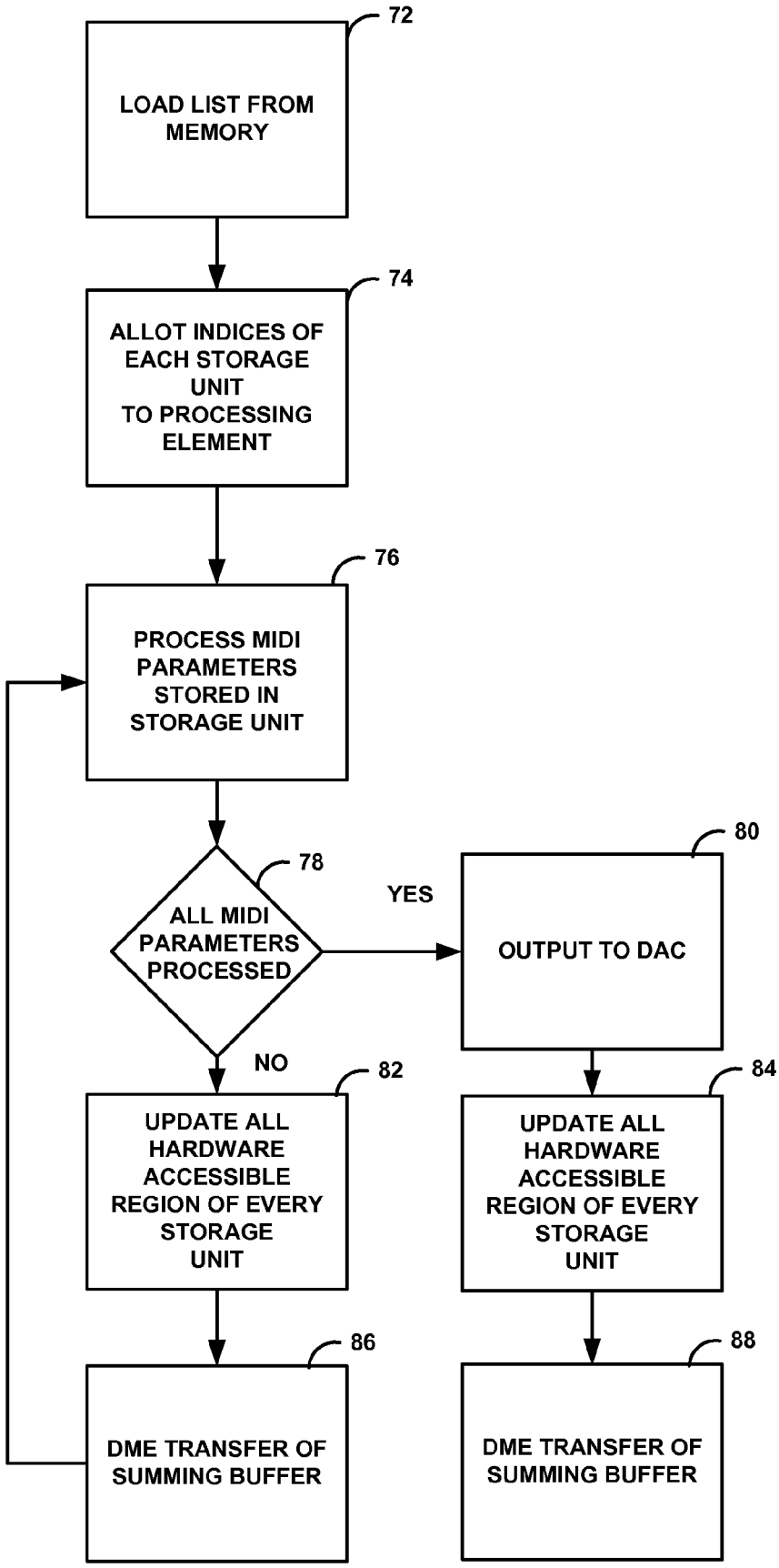
FIG. 5 is a flow chart illustrating an example of operation of a MIDI hardware unit of the audio device.

FIG. 5 is a flowchart illustrating an example of operation of MIDI hardware unit 12. Initially, MIDI hardware unit 12 may load the list of indices from memory 50 through coordination module 32 (72). Each storage unit 18A-18N may be assigned an index value. Coordination module 32 may load the list in multiple bursts of 16. If the list size is not a multiple of 16, the remainder of the data may be discarded. After loading the list of indices, coordination module 32 may allot indices of storage units 18 within memory 50 to processing elements 34 (74). Processing elements 34 may be associated with storage unit 18A-18N. Each processing element corresponding to each index of storage units 18 may perform the synthesis of the MIDI parameters stored in the particular storage units 18 (76). If all MIDI parameters that need to be processed are not processed ("NO" of 78), then wave form fetch unit 36 may update one of first regions 20 and third regions 24 for the particular storage units 18 corresponding to the particular processing elements 34. In parallel, all first regions 20 and third regions 24 may be updated with parameters that may be necessary for the following voice (82). In (82) storage units 18 may be updated by the corresponding processing elements 34 assigned to the particular storage units 18. DSP 10 may set up a direct memory exchange (DME) transfer (86) to receive the content of summing buffer 40, and may perform any necessary post-processing. Each processing element corresponding to each index of storage units 18 may perform the synthesis of the MIDI parameters stored in the particular storage units 18 that may not have been processed (76). If all MIDI parameters that need to be processed are processed ("YES" of 78), then each processing elements 34 assigned to each storage units 18 may use the synthesis parameters stored in the particular storage units 18 to create audio samples which are outputted to DAC 14 (80). Wave form fetch unit 36 may update one of first regions 20 and third regions 24 for the particular storage units 18 corresponding to the particular processing elements 34. In parallel, all first regions 20 and third regions 24 of storage units 18 may be updated with parameters that may be necessary for the following voice (84). In (84) storage units 18 may be updated by the corresponding processing elements 34 assigned to the particular storage units 18. DSP 10 may set up a direct memory exchange (DME) transfer (88) to receive the content of summing buffer 40, and may perform any necessary post-processing.

Figure 6:
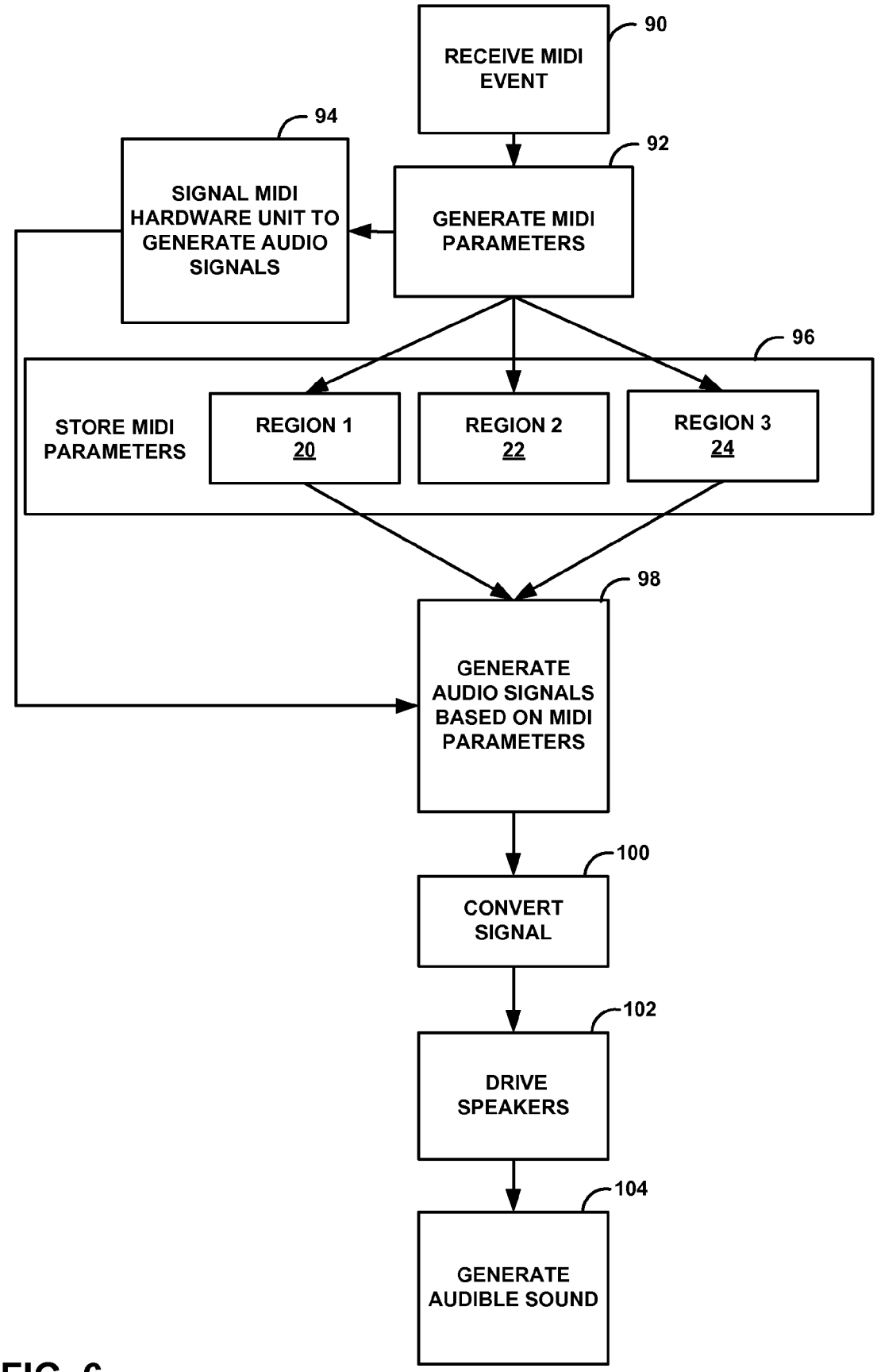
FIG. 6 is a flow chart illustrating an example operation of an audio device.

FIG. 6 is a flowchart illustrating an example operation of audio device 4. Initially, DSP 10 may receive a MIDI event from processor 8 (90). DSP 10 may generate the MIDI parameters (92). The MIDI parameters may be synthesis and non-synthesis parameters. The MIDI parameters may be stored in one of storage units 18 (96). The MIDI parameters may be stored in one of first regions 20 and second regions 22 (96) within one of storage units 18. MIDI hardware unit 12 may be signaled by DSP 10 to generate audio samples (94). The audio samples may be based on the MIDI parameters stored in one of first regions 20 and third regions 24 within one of storage units 18 (98). The audio samples may be sent back to DSP 10 for post processing. The post processed audio samples may be sent to DAC 14. DAC 14 converts the audio samples into analog signals (100). For example, DAC 14 may be implemented as a pulse width modulator, an oversampling DAC, a weighted binary DAC, an R-2R ladder DAC, a thermometer coded DAC, a segmented DAC, or another type of digital to analog converter.

After DAC 14 converts the digital waveform into an analog audio signal, DAC 14 may provide the analog audio signal to drive circuit 16 (102). Drive circuit 16 may use the analog signal to drive speakers 19 (104). Speakers 19 may be electromechanical transducers that converts the electrical analog signal into physical sound. When speakers 19 produce the sound, a user of audio device 4 may hear the sound and respond appropriately. For example, if audio device 4 is a mobile telephone, the user may answer a phone call when speakers 19 produce a ring tone sound.

In a further example of operation of audio device 4, DSP 10 may receive MIDI events and generate MIDI parameters in 10 millisecond frames, or otherwise as specified in a header of the MIDI event. MIDI hardware unit 12 may generate audio samples in 10 millisecond frames, or otherwise as specified in a header of a MIDI event. MIDI hardware unit 12 may generate audio samples at 48 kilohertz, but the process rate may be different in different implementations.

Figure 7:
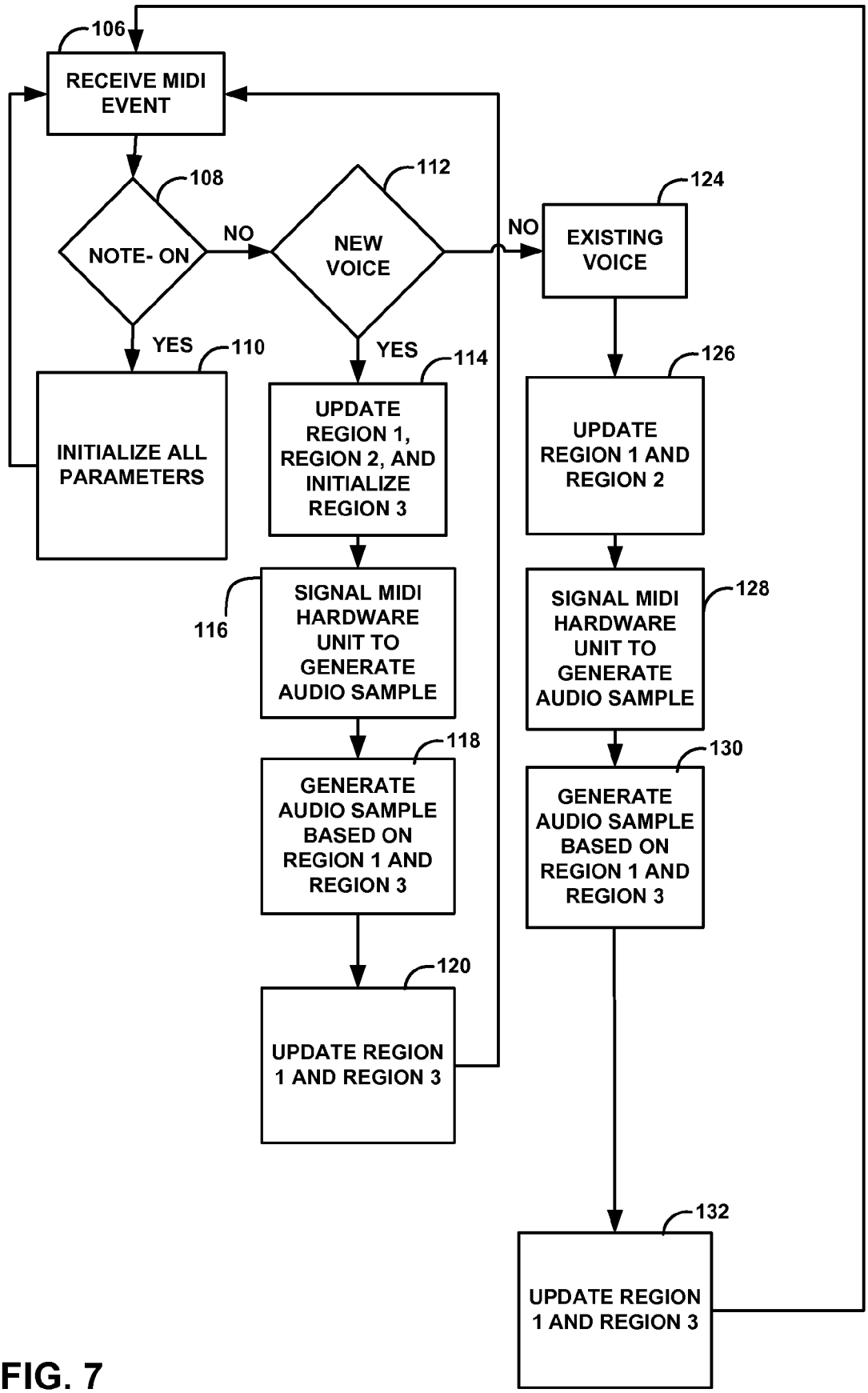
FIG. 7 is a flowchart illustrating another exemplary process for storing and processing MIDI parameters.

FIG. 7 is a flowchart illustrating an exemplary process for storing and processing MIDI parameters. Initially, DSP 10 receives a MIDI event (106) from processor 8. If the MIDI event is a note-on ("YES" of 108), then DSP 10 may initialize all parameters in one of storage units 18 to an initial value (110). DSP 10 then waits for a new MIDI event (106).

If the MIDI event is not a note-on ("NO" of 108), then if the MIDI event contains a new voice ("YES" of 112), then DSP 10 may update one of first regions 20 and second regions 22, and initialize one of third regions 24 (114) within one of storage units 18. DSP 10 may signal MIDI hardware unit 12 to generate audio samples (116). DSP 10 may schedule the processing of MIDI hardware unit 12 to generate audio samples, and may perform any post processing. MIDI hardware unit 12 may generate audio samples based on the MIDI parameters stored in one of first regions 20 and third regions 24 (118) within one of storage units 18. MIDI hardware unit 12 may update one of first regions 20 and third regions 24 (120) within one of storage units 18. DSP 10 then waits for a new MIDI event (106).

If the MIDI event does not contain a new voice ("NO" of 112), then the MIDI event may be an existing voice (124). DSP 10 may update one of first regions 20 and second regions 22 (126) within one of storage units 18. DSP 10 may signal MIDI hardware unit 12 to generate audio samples (128). MIDI hardware unit 12 may generate audio samples based on the MIDI parameters stored in one of first regions 20 and third regions 26 (130) within one of storage units 18. MIDI hardware unit 12 may update one of first regions 20 and third regions 24 (132) within one of storage units 18. DSP 10 may then wait for a new MIDI event (106).

In some examples, the techniques of this disclosure may be embodied on a computer-readable medium that stores data as described herein. In this case, this disclosure may be directed to a computer readable medium that stores Musical Instrument Digital Interface (MIDI) parameters, the computer readable medium comprising, a first region including first MIDI parameters accessible by a hardware unit and a processor, a second region including second MIDI parameters accessible by the processor, and a third region including third MIDI parameters accessible by the hardware unit and initialized by the processor.

Computer-readable medium includes computer storage media. A storage media may be any available media that can be accessed by a computer. By way of example, and not limitation, such computer-readable media may comprise volatile memory such as FLASH memory or various forms of random access memory (RAM) including dynamic random access memory (DRAM), synchronous dynamic random access memory (SDRAM), static random access memory (SRAM). Computer-readable media may also comprise a combination of volatile and non-volatile memory, where the computer may read from the non-volatile memory and read from and write to the volatile memory.

Some examples described in the disclosure may be used in devices such as cell phones to generate ringtones. There may be multiple other devices that may implement techniques described in this disclosure such devices may be a network telephone, a digital music player, a music synthesizer, a wireless mobile device, a direct two-way communication device (sometimes called a walkie-talkie), a personal computer, a desktop or laptop computer, a workstation, a satellite radio device, an intercom device, a radio broadcasting device, a hand-held gaming device, a circuit board installed in a device, a kiosk device, a video game console, various computerized toys for children, an on-board computer used in an automobile, watercraft or aircraft, or a wide variety of other devices.

Various examples have been described in the disclosure. The various systems, as described above, may reduce overall memory accesses and data bandwidth in a system while maintaining data integrity of each voice. The systems described above are more efficient because the MIDI system is not making copies of the MIDI parameters and instead allocating only one common memory for all the MIDI parameters. Further, the systems described above are more efficient because they generate audio samples by only accessing a few set of the MIDI parameters, instead of all the MIDI parameters. Also, some of the data needed for a subsequent frame is already stored, instead of being generated for every frame. The systems described above also increase efficiency by splitting the processing and generating steps for creating audio samples.

One or more aspects of the techniques described herein may be implemented in hardware, software, firmware, or combinations thereof. Any features described as modules or components may be implemented together in an integrated logic device or separately as discrete but interoperable logic devices. If implemented in software, one or more aspects of the techniques may be realized at least in part by a computer-readable medium comprising instructions that, when executed, performs one or more of the methods described above. Also, this disclosure contemplates a computer-readable medium that is partitioned in the manner described herein. The computer-readable data storage medium may form part of a computer program product, which may include packaging materials. The computer-readable medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates code in the form of instructions or data structures and that can be accessed, read, and/or executed by a computer.

Code may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated software modules or hardware modules configured or adapted to perform the techniques of this disclosure.

If implemented in hardware, one or more aspects of this disclosure may be directed to a circuit, such as an integrated circuit, chipset, ASIC, FPGA, logic, or various combinations thereof configured or adapted to perform one or more of the techniques described herein. The circuit may include both the processor and one or more hardware units, as described herein, in an integrated circuit or chipset.

It should also be noted that a person having ordinary skill in the art will recognize that a circuit may implement some or all of the functions described above. There may be one circuit that implements all the functions, or there may also be multiple sections of a circuit that implement the functions. With current mobile platform technologies, an integrated circuit may comprise at least one DSP, and at least one Advanced Reduced Instruction Set Computer (RISC) Machine (ARM) processor to control and/or communicate to DSP or DSPs. Furthermore, a circuit may be designed or implemented in several sections, and in some cases, sections may be re-used to perform the different functions described in this disclosure.

These and other examples are within the scope of the following claims.

The invention claimed is:

1. An apparatus comprising:

a processor that converts a Musical Instrument Digital Interface (MIDI) event into MIDI parameters;

a hardware unit that uses the MIDI parameters to generate audio samples; and a plurality of storage units that store the MIDI parameters, wherein one or more of the plurality of storage units are partitioned into at least three regions, wherein a first region of the at least three regions is accessible by both the processor and the hardware unit, a second region of the at least three regions is accessible by the processor and inaccessible by the hardware unit, and a third region of the at least three regions is accessible by the hardware unit and inaccessible by the processor after initialization by the processor.

2. The apparatus of claim 1, wherein the MIDI parameters comprise synthesis and non-synthesis parameters.

3. The apparatus of claim 1, wherein the processor signals the hardware unit to generate audio samples.

4. The apparatus of claim 1, wherein the plurality of storage units comprise 128 storing units.

5. The apparatus of claim 1, wherein the processor receives MIDI events in 10 millisecond frames.

6. The apparatus of claim 1, wherein the hardware unit outputs audio samples in 10 millisecond frames.

7. The apparatus of claim 1, wherein the hardware unit generates audio samples at 48 kilohertz.

8. The apparatus of claim 1, wherein the processor is a digital-signal processor (DSP).

9. The apparatus of claim 1, wherein the apparatus comprises an integrated circuit.

10. A method comprising:

generating Musical Instrument Digital Interface (MIDI) parameters for a MIDI event via a processor;

generating audio samples via a hardware unit that uses the MIDI parameters;

storing MIDI parameters in a plurality of storage units of a memory, wherein at least some of the storage units are partitioned into at least three regions, and wherein the MIDI parameters are stored in one of the at least three regions based on a need to be accessed by the processor and the hardware unit;

accessing a first region of one or more of the partitioned storage units via both the hardware unit and the processor, wherein the first region is accessible by both the hardware unit and the processor;

accessing a second region of one or more of the partitioned storage units via the processor, wherein the second region is accessible by the processor and inaccessible by the hardware unit; and accessing a third region of one or more of the partitioned storage units via the hardware unit, wherein the third region is accessible by the hardware unit and inaccessible by the processor after initialization by the processor.

11. The method of claim 10, further comprising:

signaling the hardware unit to generate the audio samples via the processor; and generating the audio samples based on both the first and third region.

12. The method of claim 10, further comprising:

determining if the MIDI event is a note-on; and initializing the first, the second, and the third region when the MIDI event is the note-on.

13. The method of claim 10, further comprising:

determining if the MIDI event contains a new voice;

updating both the first and the second region of the one or more partitioned storage units via the processor when the MIDI event is the beginning of the new voice;

initializing the third region of the one or more partitioned storage units via the processor when the MIDI event is the beginning of the new voice;

signaling the hardware unit to generate the audio samples via the processor; and generating the audio samples based on both the first and third region.

14. The method of claim 10, further comprising:

determining if the MIDI event is an existing voice;

updating both the first and the second region of the one or more partitioned storage units when the MIDI event is the existing voice;

signaling the hardware unit to generate the audio samples via the processor; and generating the audio samples based on both the first and the third region.

15. The method of claim 10, further comprising, generating the MIDI parameters in a 10 millisecond frame via the processor.

16. The method of claim 10, further comprising, generating audio samples in a 10 millisecond frame via the hardware unit.

17. The method of claim 10, further comprising, generating audio samples at 48 kilohertz.

18. The method of claim 10, wherein the processor is a digital-signal-processor (DSP).

19. The method of claim 10, wherein each of the plurality of storage units is partitioned into at least three regions.

20. An apparatus comprising:

means for converting a Musical Instrument Digital Interface (MIDI) event into MIDI parameters;

means for generating audio samples based on the MIDI parameters; and means for storing the MIDI parameters, wherein the means for storing includes a plurality of storage units;

wherein each of the storage units in the means for storing is partitioned into at least three regions, wherein a first region of each of the storage units is accessible by both the means for generating and the means for converting, a second region of each of the storage units is accessible by the means for converting and inaccessible by the means for generating, and a third region of each of the storage units is accessible by the means for generating and inaccessible by the means for converting after initialization, and wherein the means for storing stores the MIDI parameters in one of the at least three regions based on a need to be accessed by the means for converting and the means for generating.

21. The apparatus of claim 20, further comprising:

means for signaling the means for generating to generate the audio samples; and means for generating the audio samples based on both the first and third region.

22. The apparatus of claim 20, further comprising:

means for determining if the MIDI event is a note-on; and means for initializing the first, the second, and the third region when the MIDI event is the note-on.

23. The apparatus of claim 20, further comprising:

means for determining if the MIDI event contains a new voice;

means for updating both the first and the second region of each of the storage units within the means for storing when the MIDI event is the beginning of the new voice;

means for initializing the third region of each of the storage units within the means for storing when the MIDI event is the beginning of the new voice;

means for signaling the means for generating to generate the audio samples; and means for generating the audio samples based on both the first and the third region.

24. The apparatus of claim 20, further comprising:

means for determining if a MIDI event is an existing voice;

means for updating both the first and the second region of each of the storage units within the means for storing when the MIDI event is the existing voice;

means for signaling the means for generating to generate the audio samples; and means for generating the audio samples based on both the first and third region.

25. The apparatus of claim 20, further comprising, means for converting MIDI parameters in a 10 millisecond frame.

26. The apparatus of claim 20, further comprising, means for generating audio samples in a 10 millisecond frame.

27. The apparatus of claim 20, further comprising, means for generating audio samples at 48 kilohertz.

28. The apparatus of claim 20, wherein the MIDI parameters comprise of synthesis and non-synthesis parameters.

29. The apparatus of claim 20, further comprising means of signaling the means for generating to generate audio samples.

30. The apparatus of claim 20, wherein the plurality of storage units comprise 128 storing units.

31. The apparatus of claim 20, wherein the means for generating generates audio samples at 48 kilohertz.

32. The apparatus of claim 20, wherein the means for converting comprises a digital-signal processor (DSP).

33. The apparatus of claim 20, wherein the apparatus comprises an integrated circuit.

34. A computer-readable medium that stores Musical Instrument Digital Interface (MIDI) parameters, the computer-readable medium comprising:

a plurality of storage units coupled to a hardware unit and a processor, wherein at least one of the storage units is partitioned into:

a first region that stores first MIDI parameters, wherein the first region is accessible by the hardware unit and the processor;

a second region that stores second MIDI parameters, wherein the second region is accessible by the processor and inaccessible by the hardware unit; and a third region that stores third MIDI parameters, wherein the third region is accessible by the hardware unit and inaccessible by the processor after initialization by the processor.

35. The computer-readable medium of claim 34, wherein the MIDI parameters comprise synthesis and non-synthesis parameters.

36. The computer-readable medium of claim 34, wherein the plurality of storage units comprise 128 storage units.

37. A computer-readable medium comprising instructions that upon execution:

generate Musical Instrument Digital Interface (MIDI) parameters for a MIDI event via a processor;

generate audio samples via a hardware unit that uses the MIDI parameters;

store MIDI parameters in a plurality of storage units of a memory, wherein at least some of the storage units are partitioned into at least three regions, wherein the MIDI parameters are stored in one of the at least three regions based on a need to be accessed by the processor and the hardware unit;

access a first region of one or more of the partitioned storage units via both the hardware unit and the processor, wherein the first region is accessible by both the hardware unit and the processor;

access a second region of one or more of the partitioned storage units via the processor, wherein the second region is accessible by the processor and inaccessible by the hardware unit; and access a third region of one or more of the partitioned storage units via the hardware unit, wherein the third region is accessible by the hardware unit and inaccessible by the processor after initialization by the processor.

38. The computer-readable medium of claim 37, further comprising instructions that upon execution:

signal the hardware unit to generate the audio samples via the processor; and generate the audio samples based on both the first and third region.

39. The computer-readable medium of claim 37, further comprising instructions that upon execution:

determine if the MIDI event is a note-on; and initialize the first, the second, and the third region when the MIDI event is the note-on.

40. The computer-readable medium of claim 37, further comprising instructions that upon execution:

determine if the MIDI event contains a new voice;

update both the first and the second region of the one or more partitioned storage units via the processor when the MIDI event is the beginning of the new voice;

initialize the third region of the one or more partitioned storage units via the processor when the MIDI event is the beginning of the new voice;

signal the hardware unit to generate the audio samples via the processor; and generate the audio samples based on both the first and third region.

41. The computer-readable medium of claim 37, further comprising instructions that upon execution:

determine if the MIDI event is an existing voice;

update both the first and the second region of the one or more partitioned storage units when the MIDI event is the existing voice;

signal the hardware unit to generate the audio samples via the processor; and generate the audio samples based on both the first and the third region.

42. The computer-readable medium of claim 37, further comprising instructions that upon execution generate the MIDI parameters in a 10 millisecond frame via the processor.

43. The computer-readable medium of claim 37, further comprising instructions that upon execution generate audio samples in a 10 millisecond frame via the hardware unit.

44. The computer-readable medium of claim 37, further comprising instructions that upon execution generate audio samples at 48 kilohertz.

45. A circuit adapted to:

generate Musical Instrument Digital Interface (MIDI) parameters for a MIDI event via a processor;

generate audio samples via a hardware unit that uses the MIDI parameters;

store MIDI parameters in a plurality of storage units, wherein at least some of the storage units are partitioned into at least three regions, and wherein the MIDI parameters are stored in one of the at least three regions based on a need to be accessed by the processor and the hardware unit;

access a first region of one or more of the partitioned storage units via both the hardware unit and the processor, wherein the first region is accessible by both the hardware unit and the processor;

access a second region of one or more of the partitioned storage units via the processor, wherein the second region is accessible by the processor and inaccessible by the hardware unit; and access a third region of one or more of the partitioned storage units via the hardware unit, wherein the third region is accessible by the hardware unit and inaccessible by the processor after initialization by the processor.

46. The circuit claim 45, wherein the circuit is adapted to:

signal the hardware unit to generate the audio samples via the processor; and generate the audio samples based on both the first and third region.

47. The circuit claim 45, wherein the circuit is adapted to:

determine if the MIDI event is a note-on; and initialize the first, the second, and the third region when the MIDI event is the note-on.

48. The circuit claim 45, wherein the circuit is adapted to:

determine if the MIDI event contains a new voice;

update both the first and the second region of the one or more partitioned storage units via the processor when the MIDI event is the beginning of the new voice;

initialize the third region of the one or more storage units via the processor when the MIDI event is the beginning of the new voice;

signal the hardware unit to generate the audio samples via the processor; and generate the audio samples based on both the first and third region.

49. The circuit claim 45, wherein the circuit is adapted to:

determine if the MIDI event is an existing voice;

update both the first and the second region of the one or more partitioned storage units when the MIDI event is the existing voice;

signal the hardware unit to generate the audio samples via the processor; and generate the audio samples based on both the first and the third region.

50. The circuit claim 45, wherein the circuit is adapted to generate the MIDI parameters in a 10 millisecond frame via the processor.

51. The circuit claim 45, wherein the circuit is adapted to generate audio samples in a 10 millisecond frame via the hardware unit.

52. The circuit claim 45, wherein the circuit is adapted to generate audio samples at 48 kilohertz.

* * * * *